US005958859A

United States Patent [19]

Welch et al.

[11] Patent Number: 5,958,859

[45] Date of Patent: Sep. 28, 1999

[54] AQUEOUS BASED SOLVENT FREE CLEANER COMPOSITIONS CONTAINING A BLEND OF POLYOXYALKYLENE BLOCK COPOLYMERS

[75] Inventors: Michael C. Welch, Woodhaven; Charles O. Kerobo, Southfield; Suzanne M. Gessner, Ypsilanti; Sonia J. Patterson, Detroit, all of Mich.

[73] Assignee: BASF Corporation, Mt. Olive, N.J.

[21] Appl. No.: 08/902,013

[22] Filed: Jul. 29, 1997

[51] Int. Cl.[6] ..... C11D 1/825; C11D 3/37

[52] U.S. Cl. ..... 510/365; 510/218; 510/245; 510/280; 510/422; 510/434; 510/476; 510/506

[58] Field of Search ..... 510/421, 422, 510/505, 506, 514, 365, 245, 434, 218, 280, 476; 252/FOR 242, FOR 243

[56] References Cited

U.S. PATENT DOCUMENTS

| | | | |
|---|---|---|---|
| 2,979,528 | 4/1961 | Lundsted | 564/505 |
| 3,036,118 | 5/1962 | Jackson et al. | 560/182 |
| 3,382,176 | 5/1968 | Jakobi et al. | 510/422 |
| 4,272,394 | 6/1981 | Kaneko | 510/231 |
| 4,306,987 | 12/1981 | Kaneko | 510/231 |
| 4,836,951 | 6/1989 | Totten et al. | 510/220 |
| 5,049,303 | 9/1991 | Secemski et al. | 510/356 |
| 5,114,607 | 5/1992 | Deck et al. | 510/254 |
| 5,126,068 | 6/1992 | Burke et al. | 510/421 |
| 5,382,376 | 1/1995 | Michael | 510/413 |
| 5,501,816 | 3/1996 | Burke | 510/365 |
| 5,518,648 | 5/1996 | Welch | 510/220 |
| 5,536,348 | 7/1996 | Scialla | 510/372 |
| 5,612,305 | 3/1997 | Lewis | 510/220 |

*Primary Examiner*—Ardith Hertzog
*Attorney, Agent, or Firm*—Mark A. Frentrup; Joanne P. Will

[57] ABSTRACT

The present invention relates to an aqueous based, solvent free cleaning composition, comprising a polyoxyalkylene block copolymer triblend.

4 Claims, No Drawings

AQUEOUS BASED SOLVENT FREE CLEANER COMPOSITIONS CONTAINING A BLEND OF POLYOXYALKYLENE BLOCK COPOLYMERS

FIELD OF THE INVENTION

The present invention relates to an aqueous based, solvent free degreaser composition, and more particularly to a mixture of nonionic surfactants which effectively clean oils and greases from a variety of surfaces.

BACKGROUND OF THE INVENTION

The demand for degreasing formulations for a myriad of cleaning applications is well known. Target applications range from the light cleaning of printed electronic circuit boards to the cleaning of used automotive parts. Many formulations for these purposes contain varied levels of volatile solvents to efficiently degrease surfaces. Many heavy duty degreasing operations use heated solvent baths.

Recent concerns for environmental and toxicological effects of solvents and solvent baths have caused a full search for aqueous degreasing systems without solvent. Few surfactant based systems have been successful without at least a minor amount of solvent, for the dual purpose of cleaning and defoaming. Hence, industrial and institutional cleaning operations that require degreasing must reconcile their desire to be socially conscious with the need to remain effective.

The use of glycol ether solvents or cycloalkanes in cleaning compositions, in combination with anionic and/or nonionic surfactants, are known in the art. Examples of such systems may be found in Wittel et al., EP 376367; Kao Corporation, JP 3062896; Lyubarskay et al., SU 1300041; Bedo et al., SU T56873; and Dudesek et al., CS 220985.

Bobsein, et al, U.S. Pat. No. 4,663,082, teach a high pH water based industrial cleaning composition comprising a series of anionic surfactants, builders and alkalinity agents. In addition, the patentees teach the use of phosphate builders and chelating agents.

Henkel AG World Organization Patent No. 91/10718 discloses a composition requiring at least one anionic surfactant and at least one monocarboxylic acid.

European Patent No. 0392394B1 issued to the Nippon Paint Co. of Japan teaches a degreasing composition and a surfactant package comprising a nonionic surfactant of the polyoxyalkylene ether type with a phosphate polyethylene oxide adduct. This mix is combined with a necessary amount of alkali builder of varying types. However, the phosphate moiety is responsible for increasing the generation of foam. Finally, residual phosphorous is an environmental concern. The nominal amount of alkali builder also results in a caustic solution.

Further, European Patent No. 0084411A1 assigned to Albright & Wilson Limited teaches the use of a wide variety of nonionic surfactants or a phosphate ester with an alkanolamide and solvent. Additionally, U.S. Pat. No. 5,536,438, discloses a cleaning composition containing four nonionic surfactants (fatty alcohol ethoxylates) of different HLB values; U.S. Pat. No. 5,518,648 discloses a dishwashing composition comprising 2 nonionic surfactants of the alcohol alkoxylate type and a block copolymer of EO/PO; U.S. Pat. No. 5,382,376, discloses a detergent composition comprising: (a) EO/PO/EO block copolymer, (b) cosurfactants such as EO/PO/EO block copolymers with a hydrophobic moiety, (c) hydrophobic solvents such as alkylbenzenes;

U.S. Pat. No. 5,049,376 discloses a detergent composition comprising surfactants selected from anionic, zwitterionic, cationic and nonionic; non phosphate builders, EO/PO block copolymers, and a polycarboxylate polymer.

Finally, U.S. Pat. No. 5,501,816 (US '816) discloses ternary surfactant blends comprising: alcohol alkoxylate with a fatty alcohol moiety, alkyl phenol alkoxylates and alkyl oxyethylates. Additionally, US '816 discloses that polycarboxylate polymers enhance the cleaning power of the triblend compositions.

Conversely, Applicants ternary surfactant composition contains a polyoxyalkylene block copolymer which provides safe and effective cleaning power. Further, the present invention does not require the use of polycarboxylate polymers to enhance cleaning performance.

SUMMARY OF THE INVENTION

The present invention relates to an aqueous based, solvent free degreaser composition, comprising on a weight basis:

(a) about 0.15% to 5% of a nonionic surfactant characterized as a block or heteric/block polyoxyalkylene polymer having a cloud point in a 1 weight percent aqueous solution of about 10° C. to about 100° C. and a molecular weight ranging from about 1,000 to 12,000 having the Formula I:

$$Y[(A)_o(EO)_m(A)_nH]_x \qquad \text{I}$$

wherein Y represents the nucleus of an active hydrogen-containing organic compound having a functionality of x and (1) about 2 to about 6 carbon atoms and 2 to 4 reactive hydrogen atoms or (2) about 6 to about 18 carbon atoms and 2 to 3 reactive hydrogen atoms; A represents propylene oxide (i.e. oxypropylene), wherein up to 25 percent by weight of A is reacted directly with said organic compound in Formula I and 75 percent by weight or more of A is subsequently reacted to produce the said polymer; o is within the range of about 0 to 26, m is within the range of about 0 to 110, and n is within the range of about 0 to 26.

(b) about 0.15% to 5% of a nonionic surfactant characterized as a block or heteric/block polyoxyalkylene polymer having a cloud point in a 1 weight percent aqueous solution of about 10° C. to about 100° C. and a molecular weight ranging from about 1,500 to 15,000 having the Formula II:

$$Y[(A)_o(EO/A)_m(A)_nH]_x \qquad \text{II}$$

wherein Y represents the nucleus of an active hydrogen-containing organic compound having a functionality of x and (1) about 2 to about 6 carbon atoms and 2 to 4 reactive hydrogen atoms or (2) about 6 to about 18 carbon atoms and 2 to 3 reactive hydrogen atoms; A represents a lower alkylene oxide selected from the group consisting of propylene oxide (oxypropylene), butylene oxide (oxybutylene) or tetrahydrofuran or mixtures thereof wherein up to 25 percent by weight of A is reacted directly with said organic compound in admixture with ethylene oxide in Formula II and 75 percent by weight or more of A is subsequently reacted to produce the said polymer; o is within the range of about 0 to 26, m is within the range of about 0 to 110, and n is within the range of about 0 to 26.

(c) about 0.15% to 5% of a nonionic surfactant characterized as a block or heteric/block polyoxyalkylene polymer having a cloud point in a 1 weight percent aqueous solution of about 10° C. to about 100° C. and a molecular weight ranging from about 1,000 to 10,000 having the Formula I:

$$Y[(A)_o(EO)_m(A)_nH]_x \quad \text{I}$$

wherein Y represents the nucleus of an active hydrogen-containing organic compound having a functionality of x and (1) about 2 to about 6 carbon atoms and 2 to 4 reactive hydrogen atoms or (2) about 6 to about 18 carbon atoms and 2 to 3 reactive hydrogen atoms; A represents butylene oxide (i.e. oxybutylene) wherein up to 25 percent by weight of A is reacted directly with said organic compound in Formula I and 75 percent by weight or more of A is subsequently reacted to produce the said polymer; o is within the range of about 0 to 26, m is within the range of about 0 to 110, and n is within the range of about 0 to 26.

(d) water.

The above formulation may also contain about 0.005 to 1% of at least one polycarboxylate polymer of the following Formula:

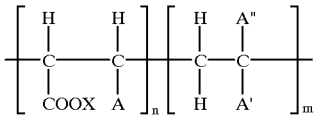

wherein x=H, Na or similar alkali or alkaline metal, A=H, COOH, COONa or similar salts, A' is COOH, COONa, or similar salts, or ——$OCH_3$ or an alkyl group having a chain length of about 4 to 20 carbon atoms, A"=H or $CH_3$, and m and n are numbers such that the monomer ratio is within the range of about 10:1 to 1:10 and the total molecular weight of the polymer is within the range of about 1,000 to 70,000.

DETAILED DESCRIPTION

The present invention relates to an aqueous based, solvent free degreaser composition, comprising on a weight basis:

(a) about 0.15% to 5% of a nonionic surfactant characterized as a block or heteric/block polyoxyalkylene polymer having a cloud point in a 1 weight percent aqueous solution of about 10° C. to about than 100° C. and a molecular weight ranging from about 1,000 to 12,000 having the Formula I:

$$Y[(A)_o(EO)_m(A)_nH]_x \quad \text{I}$$

wherein Y represents the nucleus of an active hydrogen-containing organic compound having a functionality of x and (1) about 2 to about 6 carbon atoms and 2 to 4 reactive hydrogen atoms or (2) about 6 to about 18 carbon atoms and 2 to 3 reactive hydrogen atoms; A represents propylene oxide (i.e. oxypropylene), wherein up to 25 percent by weight of A is reacted directly with said organic compound in Formula I and 75 percent by weight or more of A is subsequently reacted to produce the said polymer; o is within the range of about 0 to 26, m is within the range of about 0 to 110, and n is within the range of about 0 to 26.

(b) about 0.15% to 5% of a nonionic surfactant characterized as a block or heteric/block polyoxyalkylene polymer having a cloud point in a 1 weight percent aqueous solution of about 10° C. to about 100° C. and a molecular weight ranging from about 1,500 to 15,000 having the Formula II:

$$Y[(A)_o(EO/A)_m(A)_nH]_x \quad \text{II}$$

wherein Y represents the nucleus of an active hydrogen-containing organic compound having a functionality of x and (1) about 2 to about 6 carbon atoms and 2 to 4 reactive hydrogen atoms or (2) about 6 to about 18 carbon atoms and 2 to 3 reactive hydrogen atoms; A represents a lower alkylene oxide selected from the group consisting of propylene oxide (oxypropylene), butylene oxide (oxybutylene) or tetrahydrofuran or mixtures thereof wherein up to 25 percent by weight of A is reacted directly with said organic compound in admixture with ethylene oxide in Formula II and 75 percent by weight or more of A is subsequently reacted to produce the said polymer; o is within the range of about 0 to 26, m is within the range of about 0 to 110, and n is within the range of about 0 to 26.

(c) about 0.15% to 5% of a nonionic surfactant characterized as a block or heteric/block polyoxyalkylene polymer having a cloud point in a 1 weight percent aqueous solution of about 10° C. to about 100° C. and a molecular weight ranging from about 1,000 to 10,000 having the Formula I:

$$Y[(A)_o(EO)_m(A)_nH]_x \quad \text{I}$$

wherein Y represents the nucleus of an active hydrogen-containing organic compound having a functionality of x and (1) about 2 to about 6 carbon atoms and 2 to 4 reactive hydrogen atoms or (2) about 6 to about 18 carbon atoms and 2 to 3 reactive hydrogen atoms; A represents butylene oxide (i.e. oxybutylene) wherein up to 25 percent by weight of A is reacted directly with said organic compound in Formula I and 75 percent by weight or more of A is subsequently reacted to produce the said polymer; o is within the range of about 0 to 26, m is within the range of about 0 to 110, and n is within the range of about 0 to 26.

(d) water.

The above formulation may also contain about 0.005 to 1% of at least one polycarboxylate polymer of the following Formula:

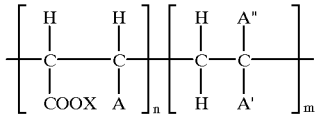

wherein x=H, Na or similar alkali or alkaline metal, A=H, COOH, COONa or similar salts, A' is COOH, COONa, or similar salts, or ——$OCH_3$ or an alkyl group having a chain length of about 4 to 20 carbon atoms, A"=H or $CH_3$, and m and n are numbers such that the monomer ratio is within the range of about 10:1 to 1:10 and the total molecular weight of the polymer is within the range of about 1,000 to 70,000.

Preparation of the Degreaser Composition of the Present Invention

The (c) degreaser composition of the present invention is prepared by blending elements (a), (b), according to methods known to those skilled in the art. Elements (a), (b), and (c) are also known as nonionic surfactants.

(a) The Polyoxyalkylene Block Copolymer

The polyoxyalkylene block copolymer is a nonionic surfactant characterized as a block or heteric/block polyoxyalkylene having a cloud point in a 1 weight percent aqueous solution of about 10° C. to about 100° C. and a molecular weight ranging from about 1,000 to 12,000 having the Formula I:

$$Y[(A)_o(EO)_m(A)_nH]_x \quad \text{I}$$

wherein Y represents the nucleus of an active hydrogen-containing organic compound having a functionality of x and (1) about 2 to about 6 carbon atoms and 2 to 4 reactive hydrogen atoms or (2) about 6 to about 18 carbon atoms and 2 to 3 reactive hydrogen atoms; A represents propylene oxide (i.e. oxypropylene) wherein up to 25 percent by weight of A is reacted directly with said organic compound in Formula I and 75 percent by weight or more of A is subsequently reacted to produce the said polymer; o is within the range of about 0 to 26, m is within the range of about 0 to 110, and n is within the range of about 0 to 26.

Further, the molecular weight of Formula I is from about 1,000 to 12,000, preferably from about 1,000 to 8,000 and more preferably from about 1,900 to 5,000.

The polyoxyalkylene block copolymer of Formula I will make up about 0.15 to 5.0% by weight of the total cleaner composition. More preferably, this component will comprise about 0.17 to 3.3% of the total composition, and even desirably will be present in an amount of about 0.5 to 2% by weight of the total formulation.

(b) The Polyoxvalkylene Block Copolymer

The polyoxyalkylene block copolymer is a nonionic surfactant characterized as a block or heteric/block polyoxyalkylene having a cloud point in a 1 weight percent aqueous solution of about 10° C. to about 100° C. and a molecular weight from about 1,500 to 15,000 having the Formula II:

$$Y[(A)_o(EO/A)_m(A)_nH]_x \qquad \text{II}$$

wherein Y represents the nucleus of an active hydrogen-containing organic compound having a functionality of x and (1) about 2 to about 6 carbon atoms and 2 to 4 reactive hydrogen atoms or (2) about 6 to about 18 carbon atoms and 2 to 3 reactive hydrogen atoms; A represents a lower alkylene oxide selected from the group consisting of propylene oxide (oxypropylene), butylene oxide (oxybutylene) or tetrahydrofuran or mixtures thereof wherein up to 25 percent by weight of A is reacted directly with said organic compound in admixture with ethylene oxide in Formula II and 75 percent by weight or more of A is subsequently reacted to produce the said polymer; o is within the range of about 0 to 26, m is within the range of about 0 to 110, and n is within the range of about 0 to 26.

Further, the molecular weight of Formula II is from 1,500 to 15,000, preferably about 1,700 to 9,000 and more preferably from about 2,000 to 6,000. A is preferably oxypropylene in Formula II.

The polyoxyalkylene block copolymer of Formula II will make up about 0.15 to 5.0% by weight of the total cleaner composition. More preferably, this component will comprise about 0.17 to 3.3% of the total composition, and even desirably will be present in an amount of about 0.5 to 2% by weight of the total formulation.

(c) The Polyoxyalkylene Block Copolymer

The polyoxyalkylene block copolymer is a nonionic surfactant characterized as a block or heteric/block polyoxyalkylene having a cloud point in a 1 weight percent aqueous solution of about 10° C. to about 100° C. and a molecular weight from about 1,000 to 10,000, having the Formula I:

$$Y[(A)_o(EO)_m(A)_nH]_x \qquad \text{I}$$

wherein Y represents the nucleus of an active hydrogen-containing organic compound having a functionality of x and (1) about 2 to about 6 carbon atoms and 2 to 4 reactive hydrogen atoms or (2) about 6 to about 18 carbon atoms and 2 to 3 reactive hydrogen atoms; A represents butylene oxide (i.e. oxybutylene) wherein up to 25 percent by weight of A is reacted directly with said organic compound in Formula I and 75 percent by weight or more of A is subsequently reacted to produce the said polymer; o is within the range of about 0 to 26, m is within the range of about 0 to 110, and n is within the range of about 0 to 26.

Further, the molecular weight of Formula I is from about 1,000 to 10,000 preferably from about 1,500 to 6,000; more preferably from about 1,900 to 4,500.

The polyoxyalkylene block copolymer will make up about 0.15 to 5.0% by weight of the total cleaner composition. More preferably, this component will comprise about 0.17 to 3.3% of the total composition, and even desirably will be present in an amount of about 0.5 to 2.0% by weight of the total formulation.

The remainder of the degreaser composition will comprise water.

It has also been found that the ternary combination of the above combination of nonionic surfactants may optionally contain at least one polycarboxylate based polymer or copolymer further enhances the efficacy of the degreaser composition.

Preferably, the polycarboxylate polymer or copolymer has the following formula:

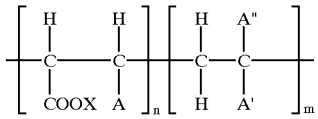

wherein x=H, Na or similar alkali or alkaline metal, A=H, COOH, COONa or similar salts, A' is COOH, COONa, or similar salts, or ——$OCH_3$ or an alkyl group having a chain length of about 4 to 20 carbon atoms, A"=H or $CH_3$, and m and n are numbers such that the monomer ratio is within the range of about 10:1 to 1:10 and the total molecular weight of the polymer or copolymer is within the range of about 1,000 to 70,000. (Unless otherwise specified, all molecular weights herein are expressed in terms of weight average molecular weight, or M(w)).

Polyacrylic acid having the above formula is useful as the polycarboxylate additive. An excellent copolymer having the above formula is acrylic acid/maleic acid copolymer. Those skilled in the art may also find that certain mixtures of polymers and copolymers according to the formula heretofore set forth may also may utility as part of the degreaser composition, and therefore these are also within the scope of the invention.

Illustrative methods for preparing the various useful polycarboxylate polymers and copolymers of the invention may be found in Burke et al., U.S. Pat. No. 5,126,068, incorporated herein by reference.

An especially preferred monomer ratio for the polycarboxylate copolymer is about 1:1. A monomeric ratio within the range of about 3:1 to 1:3 is also preferred. A preferred molecular weight range is about 1,000 to 25,000, and even more preferably from about 8,000 to 12,000.

Especially useful copolymers as part of the degreaser composition include the following structures. A polycarboxylate copolymer with a molecular weight of about 12,000, and X=Na, A=COONa, A'=$C_5H_{11}$, A"=$CH_3$ and the monomeric ratio is about 1:1 A polycarboxylate copolymer with a molecular weight of about 70,000, X=Na, A=COONa, A'=$OCH_3$, A"=H and the monomeric ratio is about 1:1. In addition, polyacrylic acid with a molecular weight of about 8,000, where X=Na is also effective as part of the invention. This polyacrylic acid may be obtained from BASF Corp. under the tradename SOKALAN™ PA 30 CL.

The polycarboxylate polymer or copolymer as part of the invention is added to the degreaser composition in amounts of about 0.005 to 1% by weight based upon the total weight of the composition. Preferably, the polymer or copolymer will comprise from about 0.01 to 0.5% of the total formulation.

The Utility of the Present Invention

The cleaning composition according to the various embodiments of the invention is extremely useful in industrial, institutional, and household cleaning and degreasing of surfaces, including but not limited to, glass, ceramic, rigid and flexible hard surfaces, carpeting and metal, especially automotive parts. The cleaning composition may be applied by methods including but not limited to dipping, soaking, wiping, sonicating, spraying, and especially pressure spray washing. Further, the cleaning composition may be applied at a wide range of temperatures from about 40 to 200° F.

The following non limiting examples illustrate the utility of the present invention:

EXAMPLE 1

Meat Packing Equipment Cleaning Equipment (a) 0.17–3.3% of a polyoxyalkylene block copolymer of the Formula I, $$Y[(A)_o(EO)_m(A)_nH]_x$$

wherein A=oxypropylene and Formula I has a molecular weight of 1,900.

(b) 0.17–3.3% of a polyoxyalkylene block copolymer of the Formula II, $$Y[(A)_o(EO/A)_m(A)_nH]_x$$

wherein A=oxypropylene and Formula II has a molecular weight is 2,000.

(c) 0.17–3.3% of a polyoxyalkylene block copolymer of the Formula I, $$Y[(A)_o(EO)_m(A)_nH]_x$$

wherein A=oxybutylene and Formula I has a molecular weight of 2,500.

EXAMPLE 2

Household Hard Surface Cleaning Composition (a) 0.5–2.0% of a polyoxyalkylene block copolymer of the Formula I, $$Y[(A)_o(EO)_m(A)_nH]_x$$

wherein A=oxypropylene and Formula I has a molecular weight of 2,600.

(b) 0.5–2.0% of a polyoxyalkylene block copolymer of the Formula II, $$Y[(A)_o(EO/A)_m(A)_nH]_x$$

wherein A=oxypropylene and the molecular weight of Formula II is 3,100.

$$Y[(A)_o(EO)_m(A)_nH]_x$$

(c) 0.5–2.0% of a polyoxyalkylene block copolymer of the Formula I, $$Y[(A)_o(EO)_m(A)_nH]_x$$

wherein A=oxybutylene and Formula I has a molecular weight of 1,900.

EXAMPLE 3

Carpet Cleaning Composition (a) 0.5–2.0% of a polyoxyalkylene block copolymer of the Formula I, $$Y[(A)_o(EO)_m(A)_nH]_x$$

wherein A=oxypropylene and Formula I has a molecular weight of 2,1 00.

(b) 0.5–2.0% of a polyoxyalkylene block copolymer of the Formula I, $$Y[(A)_o(EO/A)_m(A)_nH]_x$$

wherein A=oxypropylene and the molecular weight of Formula I is 4,500.

(c) 0.5–2.0% of a polyoxyalkylene block copolymer of the Formula I, $$Y[(A)_o(EO)_m(A)_nH]_x$$

wherein A=oxybutylene and Formula I has a molecular weight of 2,500.

(d) 0.01 to 0.5% polycarboxylate polymer of the Formula:

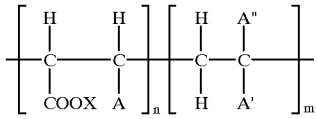

wherein the molecular weight is about 12,000, and X=Na, A=COONa, A'=$C_5H_{11}$, A"=$CH_3$ and the monomeric ratio is about 1:1

EXAMPLE 4

Industrial Cleaning Composition (a) 0.17–3.3% of a polyoxyalkylene block copolymer of the Formula I, $$Y[(A)_o(EO)_m(A)_nH]_x$$

wherein A=oxypropylene and Formula I has a molecular weight of 2,600.

(b) 0.17–3.3% of a polyoxyalkylene block copolymer of the Formula II, $$Y[(A)_o(EO/A)_m(A)_nH]_x$$

wherein A=oxypropylene and the molecular weight of Formula II is 3,600.

(c) 0.17 to 3.3% of a polyoxyalkylene block copolymer of the Formula I, $$Y[(A)_o(EO)_m(A)_nH]_x$$

wherein A=oxybutylene and Formula I has a molecular weight of 5,500.

While the invention has been described in each of its various embodiments, it is to be expected that certain modifications thereto may be made by those skilled in the art without departing from the true spirit and scope of the invention as set forth in the specification and the accompanying claims.

We claim:

1. An aqueous based, solvent free degreaser composition, consisting essentially of on a weight basis:

(a) about 0.15% to 5% of a nonionic surfactant characterized as a block or heteric/block polyoxyalkylene polymer having a cloud point in a 1 weight percent aqueous solution of about 10° C. to about 100° C. and a molecular weight ranging from about 1,000 to 12,000 having the Formula I:

$$Y[(A)_o(EO)_m(A)_nH]_x \quad \text{I}$$

wherein Y represents the nucleus of an active hydrogen-containing organic compound having a functionality of x and (1) about 2 to about 6 carbon atoms and 2 to 4 reactive hydrogen atoms or (2) about 6 to about 18 carbon atoms and 2 to 3 reactive hydrogen atoms; A represents propylene oxide wherein up to 25 percent by weight of A is reacted directly with said organic compound in Formula I and 75 percent by weight or more of A is subsequently reacted to produce the said polymer; o is within the range of about 0 to 26, m is within the range of about 0 to 110, and n is within the range of about 0 to 26;

(b) about 0.15% to 5% of a nonionic surfactant characterized as a block or heteric/block polyoxyalkylene polymer having a cloud point in a 1 weight percent aqueous solution of about 10° C. to about 100° C. and a molecular weight ranging from about 1,500 to 15,000 having the Formula II:

$$Y[(A)_o(EO/A)_m(A)_nH]_x \quad \text{II}$$

wherein Y represents the nucleus of an active hydrogen-containing organic compound having a functionality of x and (1) about 2 to about 6 carbon atoms and 2 to 4 reactive hydrogen atoms or (2) about 6 to about 18 carbon atoms and 2 to 3 reactive hydrogen atoms; A represents a lower alkylene oxide selected from the group consisting of propylene oxide, butylene oxide, tetrahydrofuran, and mixtures thereof wherein up to 25 percent by weight of A is reacted directly with said organic compound in admixture with ethylene oxide in Formula II and 75 percent by weight or more of A is subsequently reacted to produce the said polymer; o is within the range of about 0 to 26, m is within the range of about 0 to 110, and n is within the range of about 0 to 26;

(c) about 0.15% to 5% of a nonionic surfactant characterized as a block or heteric/block polyoxyalkylene polymer having a cloud point in a 1 weight percent aqueous solution of about 10° C. to about 100° C. and a molecular weight ranging from about 1,000 to 10,000 having the Formula I:

$$Y[(A)_o(EO)_m(A)_nH]_x \quad \text{I}$$

wherein Y represents the nucleus of an active hydrogen-containing organic compound having a functionality of x and (1) about 2 to about 6 carbon atoms and 2 to 4 reactive hydrogen atoms or (2) about 6 to about 18 carbon atoms and 2 to 3 reactive hydrogen atoms; A represents butylene oxide wherein up to 25 percent by weight of A is reacted directly with said organic compound in Formula I and 75 percent by weight or more of A is subsequently reacted to produce the said polymer; o is within the range of about 0 to 26, m is within the range of about 0 to 110, and n is within the range of about 0 to 26; and (d) the balance being water.

2. An aqueous based solvent free degreaser composition according to claim 1 comprising:

(a) 0.17–3.3% of a polyoxyalkylene block copolymer of the Formula I, $$Y[(A)_o(EO)_m(A)_nH]_x$$

wherein A=oxypropylene and Formula I has a molecular weight of 1,900, (b) 0.17–3.3% of a polyoxyalkylene block copolymer of the Formula II, $$Y[(A)_o(EO)_m(A)_nH]_x$$

wherein A=oxypropylene and Formula II has a molecular weight is 2,000, and (c) 0.17–3.3% of a polyoxyalkylene block copolymer of the Formula I, $$Y[(A)_o(EO)_m(A)_nH]_x$$

wherein A=oxybutylene and Formula I has a molecular weight of 2,500.

3. An aqueous based, solvent free degreaser composition, consisting essentially of on a weight basis:

(a) about 0.15% to 5% of a nonionic surfactant characterized as a block or heteric/block polyoxyalkylene polymer having a cloud point in a 1 weight percent aqueous solution of about 10° C. to about 100° C. and a molecular weight ranging from about 1,000 to 12,000 having the Formula I:

$$Y[(A)_o(EO)_m(A)_nH]_x \quad \text{I}$$

wherein Y represents the nucleus of an active hydrogen-containing organic compound having a functionality of x and (1) about 2 to about 6 carbon atoms and 2 to 4 reactive hydrogen atoms or (2) about 6 to about 18 carbon atoms and 2 to 3 reactive hydrogen atoms; A represents propylene oxide, wherein up to 25 percent by weight of A is reacted directly with said organic compound in Formula I and 75 percent by weight or more of A is subsequently reacted to produce the said polymer; o is within the range of about 0 to 26, m is within the range of about 0 to 110, and n is within the range of about 0 to 26;

(b) about 0.15% to 5% of a nonionic surfactant characterized as a block or heteric/block polyoxyalkylene polymer having a cloud point in a 1 weight percent aqueous solution of about 10° C. to about 100° C. and a molecular weight ranging from about 1,500 to 15,000 having the Formula II:

$$Y[(A)_o(EO/A)_m(A)_nH]_x \quad \text{II}$$

wherein Y represents the nucleus of an active hydrogen-containing organic compound having a functionality of x and (1) about 2 to about 6 carbon atoms and 2 to 4 reactive hydrogen atoms or (2) about 6 to about 18 carbon atoms and 2 to 3 reactive hydrogen atoms; A represents a lower alkylene oxide selected from the group consisting of propylene oxide, butylene oxide, tetrahydrofuran, and mixtures thereof wherein up to 25 percent by weight of A is reacted directly with said organic compound in admixture with ethylene oxide in Formula II and 75 percent by weight or more of A is subsequently reacted to produce the said polymer; o is within the range of about 0 to 26, m is within the range of about 0 to 110, and n is within the range of about 0 to 24;

(c) about 0.15% to 5% of a nonionic surfactant characterized as a block or heteric/block polyoxyalkylene polymer having a cloud point in a 1 weight percent aqueous solution of about 10° C. to about 100° C. and a molecular weight ranging from about 1,000 to 10,000 having the Formula I:

$$Y[(A)_o(EO)_m(A)_nH]_x$$

wherein Y represents the nucleus of an active hydrogen-containing organic compound having a functionality of x and (1) about 2 to about 6 carbon atoms and 2 to 4 reactive hydrogen atoms or (2) about 6 to about 18 carbon atoms and 2 to 3 reactive hydrogen atoms; A represents butylene oxide wherein up to 25 percent by weight of A is reacted directly with said organic compound in Formula I and 75 percent by weight or more of A is subsequently reacted to produce the said polymer; o is within the range of about 0 to 26, m is within the range of about 0 to 110, and n is within the range of about 0 to 26;

(d) about 0.005 to 1% of at least one polycarboxylate polymer of the following formula:

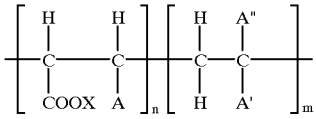

wherein X=H, alkali metal, or alkaline earth metal, A=H or COO—Y , A'=COO=Y , wherein Y=H, alkali metal, $CH_3$ or an alkyl group having a chain length of about 4 to 20 carbon atoms, A"=H or $CH_3$, and m and n are numbers such that the monomer ratio is within the range of about 10:1 to 1:10 and the total molecular weight of the polymer is within the range of about 1,000 to 70,000; and (e) the balance being water.

4. An aqueous based solvent free degreaser composition according to claim 3 comprising:

(a) 0.5–2.0% of a polyoxyalkylene block copolymer of the Formula I, $$Y[(A)_o(EO)_m(A)_nH]_x$$

wherein A=oxypropylene and Formula I has a molecular weight of 2,100, (b) 0.5–2.0% of a polyoxyalkylene block copolymer of the Formula II, $$Y[(A)_o(EO)_m(A)_nH]_x$$

wherein A=oxypropylene and the molecular weight of Formula II is 4,500, (c) 0.5–2.0% of a polyoxyalkylene block copolymer of the Formula I, $$Y[(A)_o(EO)_m(A)_nH]_x$$

wherein A=oxybutylene and Formula I has a molecular weight of 2,500, and (d) 0.01 to 0.5% polycarboxylate polymer of the formula:

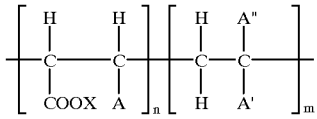

wherein the molecular weight is about 12,000, and X=Na, A=COONa, A'=$C_5H_{11}$, A"=$CH_3$ and the monomeric ratio is about 1:1.

* * * * *